US005551464A

United States Patent [19]

Kelly

[11] Patent Number: 5,551,464

[45] Date of Patent: Sep. 3, 1996

[54] HEAT REFLECTING PARASOL

[76] Inventor: Carla D. Kelly, 209 S. Collidge St., Tampa, Fla. 33609

[21] Appl. No.: 348,349

[22] Filed: Dec. 2, 1994

[51] Int. Cl.[6] ..... A45B 25/18

[52] U.S. Cl. ..... 135/33.2; 135/92; 135/98

[58] Field of Search ..... 135/33.2, 92, 98

[56] References Cited

U.S. PATENT DOCUMENTS

| | | | |
|---|---|---|---|
| 3,718,528 | 2/1973 | Bergstrom | 161/213 X |
| 3,851,164 | 11/1974 | Intrator | 240/103 X |
| 4,524,405 | 6/1985 | Heard | 362/18 |
| 4,764,779 | 8/1988 | Sato et al. | 343/897 |
| 4,962,780 | 10/1990 | Engdahl et al. | 135/33.2 |

*Primary Examiner*—Wynn E. Wood
*Attorney, Agent, or Firm*—Dominik & Stein

[57] ABSTRACT

A parasol with heat reflective qualities is disclosed having a roof material constructed such as to have three layers: one layer is a top cover layer made from a translucent material, the middle layer consisting of a metallic material to thereby provide heat reflective qualities, and an under inner cover layer made of a generally opaque nylon material to preclude any light from passing through to the user. These three layers are arrayed upon a parasol or other such frame, either collapsible or rigid in nature. These frames can vary in size and shape responding to the needs of the user or site at which to be used.

2 Claims, 2 Drawing Sheets

HEAT REFLECTING PARASOL

BACKGROUND OF THE INVENTION

1. Field of the Invention

This invention relates to a heat reflecting parasol for providing a reduction in the amount of exposure a user has to the heat producing energy of the sun.

2. Description of the Background Art

Presently, there exist many types of shading devices that involve the use of a material, such as nylon or canvas, that is fitted to a frame of various sizes and shapes. These shading devices are positioned between the sun and the user with the end result being an area of shade created for the user. An umbrella is a commonly used shading device having a collapsible jointed frame with a taut nylon covering stretched over the frame to facilitate the repelling of water and the creation of shade. Thus, when the umbrella is held above the head and shoulders of a user, rain will flow down its curved sides and cascade to the ground, avoiding the user altogether.

Although many devices are present in the industry today that create a shaded area when placed between the user and the sun, there still remains a substantial amount of heat transfer through the shading device. This transfer of heat results in the atmosphere underneath the shading device becoming just as hot as the atmosphere on the outer exposed portion of the shading device.

There are several reasons that account for the transfer and development of heat underneath the shading device. One reason that accounts for the high amount of energy transferred through the present shading devices is that the heat transfer characteristic of the shading material has minimal effect on the infrared energy that ultimately passes through the materials being commonly used in the industry today.

A second reason for the high amount of energy transfer through the prior art shading devices is attributed to the actual heat retention qualities of the specific shading material used. The shading devices being used presently in the industry tend to have shading materials that retain a high degree of heat and therefore become in effect a heat radiator to the atmosphere underneath the shading device. This heat radiating effect acts to negate the advantages of the shade provided by the shading device.

A third reason for the high amount of energy transfer through the prior art shading devices is the convection effect that is created thereby causing a flow of air to pass underneath the shading device bringing with it the hot air forming on the outside of the top. Thus, the current shading devices in the industry today operate mainly to only reflect water during rain or to provide shade from the sunlight. The current shading devices do not operate to, in effect, preclude the heat from transferring through to the atmosphere under the shading device.

Thus, due to the inadequacies of the prior art shading devices, there is a need in the industry to provide a shading device that will not only shade the user from the sun's visible light, but also from the sun's infrared rays, ultraviolet rays, and other forms of heat producing energy.

Therefore, it is an object of this invention to provide an improvement over the prior art which overcomes the aforementioned inadequacies and provides an improvement which is a significant contribution to the advancement of the shading parasol art.

Another object of this invention is to provide a heat reflecting parasol that has the ability to reduce the heat transferred to the atmosphere directly underneath the parasol and thereby provide a more tolerant climate for the user.

Another object of this invention is to provide a heat reflecting parasol having a roof assembly made from a multi-ply roof material that includes a metallic middle layer of material that thereby reduces the exposure to the infrared rays, ultraviolet rays, and heat producing energy generated by the sun that a user would have normally been exposed to when using the prior art shading devices.

Another object of this invention is to provide a heat reflecting parasol comprising in combination: a roof assembly made from a multi-ply roof material that includes an outside layer, an inside layer, and a metallic middle layer therebetween; and a frame support means for supporting said roof material, whereby said roof material is dispersed over said frame support means thereby providing reduced exposure to the infrared rays, ultraviolet rays and heat producing energy of the sun to a user thereof.

These objects should be construed to be merely illustrative of some of the more prominent features and applications of the intended invention. Many other beneficial results can be obtained by applying the disclosed invention in a different manner or by modifying the invention within the scope of the disclosure. Accordingly, other objects and a more comprehensive understanding of the invention may be obtained by referring to the Summary of the Invention, and the Detailed Description of the Preferred Embodiment in addition to the scope of the invention defined by the claims taken in conjunction with the accompanying drawings.

SUMMARY OF THE INVENTION

The invention is defined by the appended claims with the specific embodiments shown in the attached drawings. For the purposes of summarizing the invention, the invention comprises a heat reflecting parasol that is either collapsible or fixed in configuration.

More particularly, the heat reflecting parasol of the invention comprises a roof assembly having panels made from a multi-ply roof material, and a frame support means having a handle. The roof material, being of a multi-layered construction, has a metallic middle layer to thereby reflect and reduce the transfer of energy from the sun through the roof material. The handle is of sufficient proportion to support the frame means and roof material spread thereon. The frame support means is of sufficient proportion to create a shading area large enough to provide protection to a user from the sun.

In addition, the roof material contains a translucent outside layer to reduce the heat retention properties of the roof material. There is an opaque inside layer that forms the third layer of the roof material that helps reduce the amount of heat transfer through the metallic layer that might be present due to any heat retention that has occurred in the outer and metallic layers.

An important feature of the present invention is that the construction of the roof material is such that it provides a substantial reduction in the amount of heat being transferred through the roof material and resultingly felt by the end user.

Another important feature of the present invention is that the particular construction of the roof material provides a reduced amount of heat retention within the roof assembly itself.

Another important feature of the present invention is that the particular construction of the roof material reduces the convection effect which causes a flow of hot air to proceed underneath the shading device.

Another important feature of the present invention is that the outside layer of the roof material is of a translucent nature such that a strong reflection of the sun's light would not occur and cause a glaring shine to be reflected towards others.

Therefore, it can be readily appreciated that the present invention overcomes the inadequacies of the prior art in that the device greatly reduces the danger of excess exposure to the infrared rays, ultraviolet rays, and the energy of the sun in general by those who work, engage in recreational activities, or travel under sunny conditions.

The foregoing has outlined rather broadly, the more pertinent and prominent features of the present invention. The detailed description of the invention that follows is offered so that the present contribution to the art may be more fully appreciated. Additional features of the invention will be described hereinafter. These form the subject of the claims of the invention. It should be appreciated by those skilled in the art that the conception and the disclosed specific embodiment may be readily utilized as a basis for modifying or designing other methods and structures for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a more succinct understanding of the nature and objects of the invention, reference should be directed to the following description taken in conjunction with the accompanying drawings in which.

Similar reference numerals refer to similar parts throughout the several figures.

DESCRIPTION OF THE PREFERRED EMBODIMENT

Figure 1:
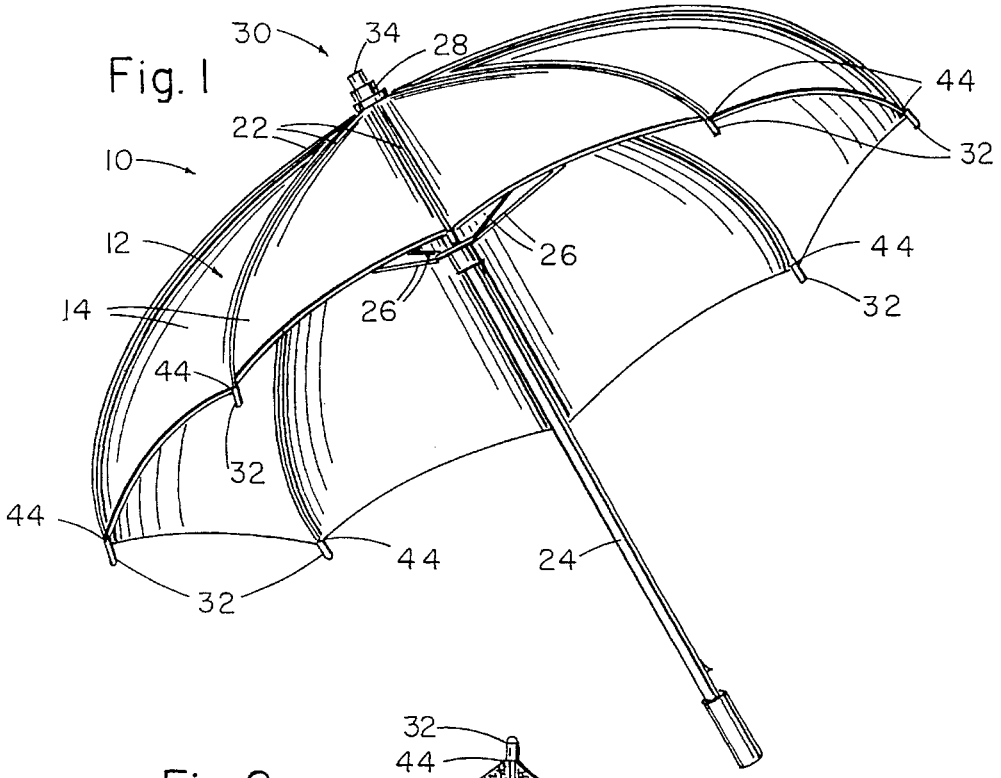
FIG. 1 is a perspective view of the heat reflecting parasol showing the handle, the roof assembly dispersed about the frame support means, and the overall relative shape of the heat reflecting parasol in its open state.
Figure 2:
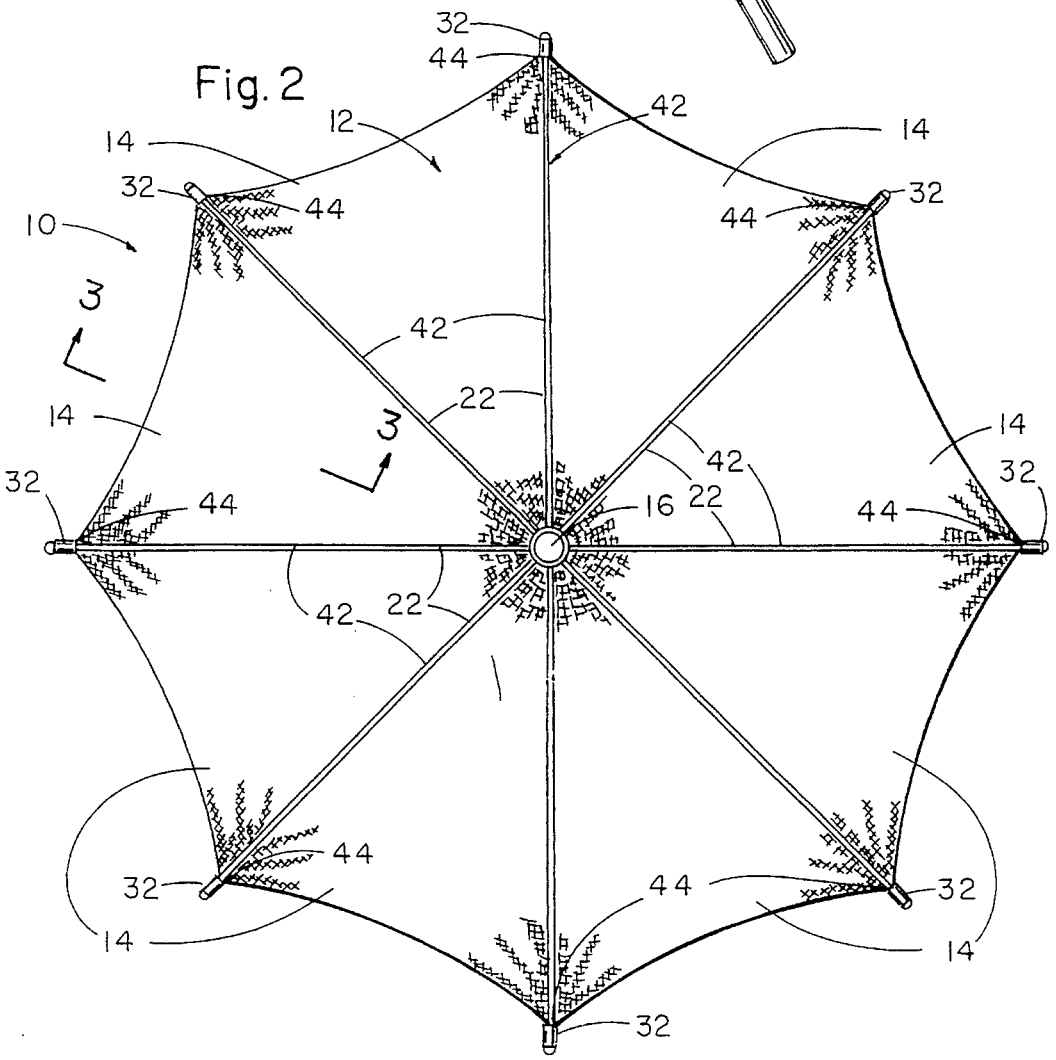
FIG. 2 is a top view of the roof assembly showing the center hole, the multiple panels, and the seams relative to each other.
Figure 3:
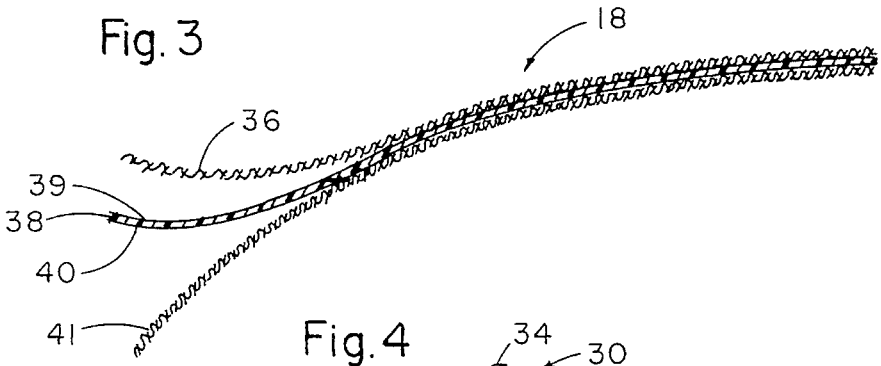
FIG. 3 is a cross-sectional view of a panel from the roof assembly in FIG. 2 taken along lines 3—3 showing the roof material construction.

In referring to FIGS. 1, 2 and 3, the heat reflecting parasol 10 is shown in its open state comprising a roof assembly 12 (as seen in FIG. 2) having a center hole 16, and a multiplicity of panels 14 made from a multi-ply roof material 18 (as illustrated in FIG. 3); and a conventional frame support means 20. The overall general shape of the heat reflecting parasol 10 is that of a dome shape. The roof assembly 12 is constructed of the individual panels 14 that are sewn together along their sides 22.

Figure 4:
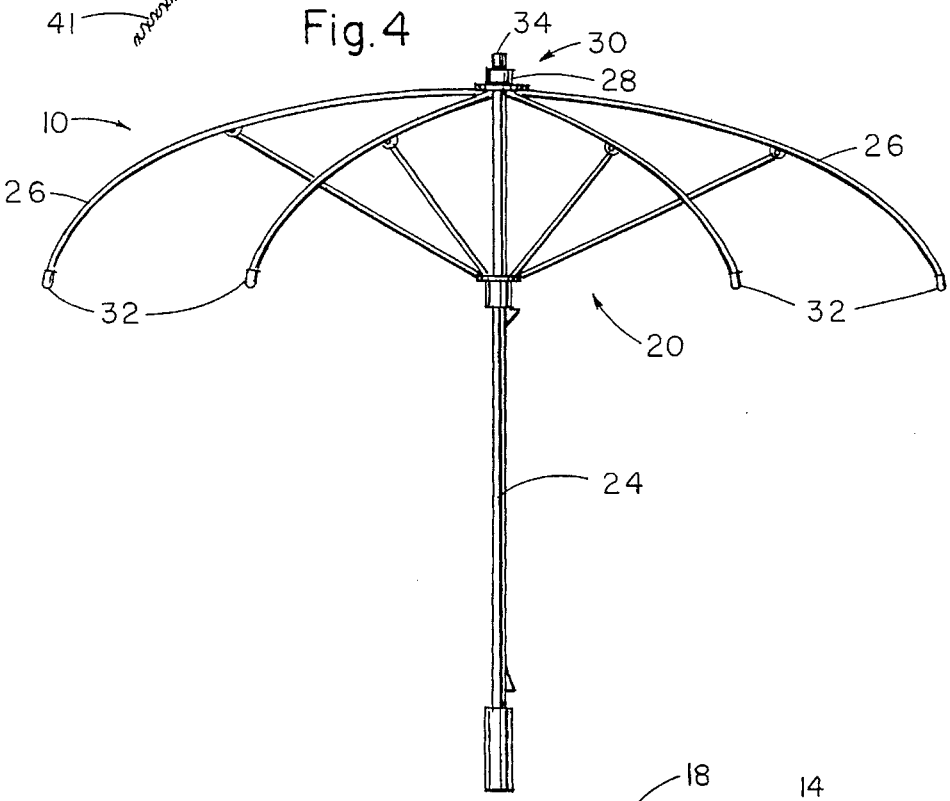
FIG. 4 is a plan view of the frame support means showing the various components and their relative positioning.

To support the roof assembly 12, the conventional frame support means 20 is utilized as seen in FIG. 4. The frame support means 20 is that which is commonly used for umbrellas. The frame support means 20 includes a longitudinal handle 24, collapsible support ribs 26, and a securing nut 28. The longitudinal handle 24 is positioned at the center of the frame support means 20. The collapsible support ribs 26 extend radially outward from the top end 30 of the longitudinal handle 24. Each collapsible support rib 26 has an outward end 32.

The roof assembly 12 is dispersed over the frame support means 20 with the collapsible support ribs 26 being extended outward. The roof assembly 12 is secured at its center hole 16 by the securing nut 28 which threadedly engages an integral extension 34 on the top end 30 of the longitudinal handle 24. The integral extension 34 passes through the center hole 16 of the roof assembly 12 thereby allowing the roof assembly 12 to be sandwiched between the top end 30 of the handle 24 and the securing nut 28.

Figure 5:
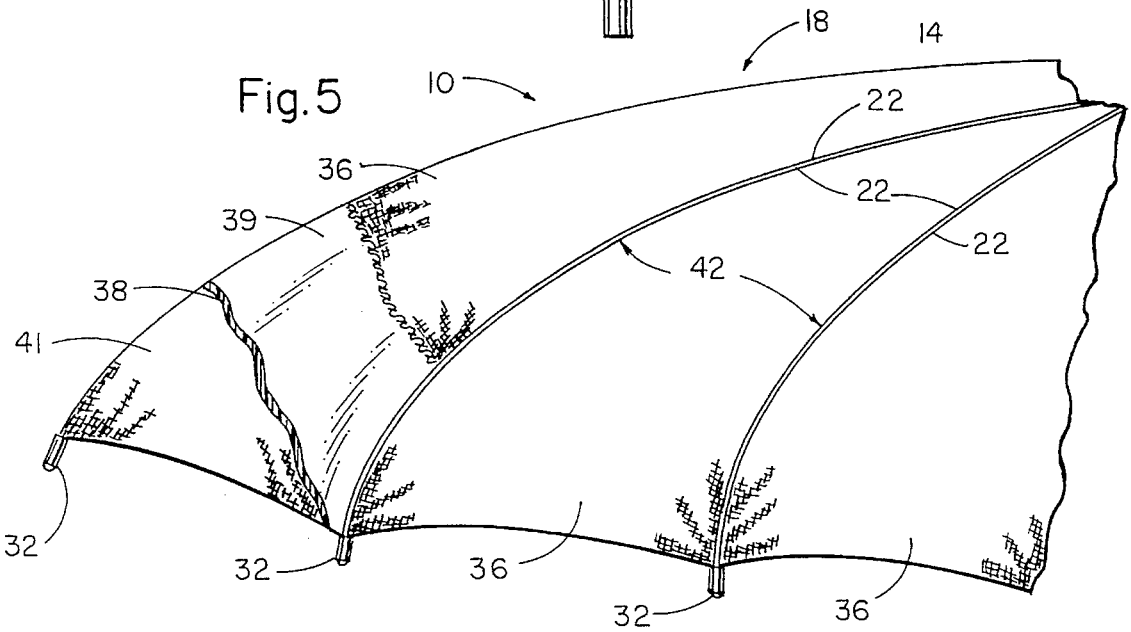
FIG. 5 is a cutaway partial cross-sectional view of two panels sewn together illustrating the multi-ply roof material and the relative positions of each individual layer of material, and the sewing seam formed between the panels.

In referring to FIGS. 3 and 5, the multi-ply roof material 18 is illustrated in detail. The roof material 18 is shown to include a translucent nylon outside layer 36, a metallic middle layer 38 having one side 39 and an opposing side 40, and an opaque nylon inside layer 41, all of which are sewn together to form the individual panels 14. The metallic middle layer 38 is made of a Mylar material so as to reflect the sun's rays and other heat producing energy. Thus, each panel 14 made out of the roof material 18 is of a three-layer construction. The individual panels 14 are then sewn together at their sides 22 forming a seam 42 between each panel 14. Each seam 42 has an outward seam end 44 of which is secured to the outward end 32 of a support rib 26. The support ribs 26 of the frame support means 20 run along the seams 42 underneath the roof assembly 12.

In an alternate embodiment, the translucent nylon outside layer 36, metallic middle layer 38, and opaque nylon inside layer 41 are all laminated together as opposed to being sewn. The roof material 18 in the glued laminate form is then cut to form the individual panels 14. The panels 14 are then sewn together at their sides 22 forming seams 42 between the panels 14. The sewn together panels 14 now form the roof assembly 12 which is dispersed over the frame support means 20 and secured thereto in a similar fashion as in the previous embodiment.

As a demonstration of the principles described above, a conventional parasol and a parasol constructed in accordance with the present invention, were placed on grass of equal length. Identically constructed thermometers were placed in the shaded area under each of the parasols. As the earth rotated, thus changing the direction from which the rays of the sun struck the parasols, the parasols were rotated to keep the thermometers in the shaded area.

Below is a recording of the temperatures noted every half hour from commencement until discontinuation due to a thunderstorm.

| Inventive Parasol | | Conventional Parasol | |
|---|---|---|---|
| TIME | TEMPERATURE | TIME | TEMPERATURE |
| 12:30 | 76.8 (inside) | 12:30 | 76.8 (inside) |
| 12:45 | 94.6 | 12:45 | 104.7 |
| 1:15 | 91.8 | 1:15 | 100.6 |
| 1:45 | 92.8 | 1:45 | 102.4 |
| 2:15 | 91.6 | 2:15 | 102.4 |
| 2:45 | 89.6 | 2:45 | 102.4 |

-continued

| Inventive Parasol | | Conventional Parasol | |
|---|---|---|---|
| TIME | TEMPERATURE | TIME | TEMPERATURE |
| 3:15 | 92.7 | 3:15 | 102.4 |
| 4:00 | 88.7 | 4:00 | 95.7 |
| 4:30 | 87.8 | 4:30 | 92.7 |
| 5:00 | EXPERIMENT DISCONTINUED DUE TO THUNDERSTORM. | | |

As can be seen, until it came overcast around 3:30 p.m., a ten degree difference was consistently achieved.

The present invention includes that contained in the appended claims as well as that of the foregoing description. Although this description has been described in its preferred form with a certain degree of particularity, it should be understood that the present disclosure of the preferred form has been made only by way of example and that numerous changes in the details of construction, combination, or arrangement of parts thereof may be resorted to without departing from the spirit and scope of the invention.

Now that the invention has been described,

What is claimed is:

1. A heat reflective parasol comprising in combination:

a multi-ply roof material having an outside layer, an inside layer and a metallic middle layer therebetween;

said metallic middle layer being composed of a reflective material so as to facilitate the reflecting of the sun's rays and energy;

said inside layer being composed generally of an opaque material to thereby prevent any light from passing through to the user;

said outside layer being composed of a translucent material thereby allowing light to be received from the sun and thereafter diffused to prevent strong reflections from said reflective metallic middle layer; and a frame support means for supporting said multi-ply roof material, whereby said roof material is dispersed about said frame support means thereby providing a reduced exposure to the heat producing energy of the sun to a user thereof.

2. A heat reflective parasol as recited in claim 1, wherein said multi-ply roof material is of a laminate construction whereby said translucent outside layer is glued to one side of said metallic middle layer and said opaque inside layer is glued to the opposing side of said metallic middle layer.

* * * * *